United States Patent [19]

Doane

[11] 4,041,830

[45] Aug. 16, 1977

[54] TEACHING UKELELE

[76] Inventor: J. Chalmers Doane, 31 Bridgeview Drive, Halifax, Nova Scotia, Canada

[21] Appl. No.: 614,373

[22] Filed: Sept. 18, 1975

[51] Int. Cl.[2] ..... G10D 3/14

[52] U.S. Cl. ..... 84/305; 84/173; 84/291; 84/297 R

[58] Field of Search ..... 84/173, 267, 268, 284, 84/285, 290–293, 297–307, 314; D56/1 A

[56] References Cited

U.S. PATENT DOCUMENTS

| | | | |
|---|---|---|---|
| 495,823 | 4/1893 | Middlebrook | 84/293 |
| 976,428 | 11/1910 | Benson et al. | 84/298 |
| 1,317,830 | 10/1919 | Sivard | 84/314 |
| 1,690,340 | 11/1928 | Howard | 84/293 |
| 2,214,957 | 9/1940 | Furgiuele | 84/314 |
| 3,820,434 | 6/1974 | Roberts | 84/297 S |
| D. 205,601 | 8/1966 | Swagerty | D56/1 A |

*Primary Examiner*—Lawrence R. Franklin
*Attorney, Agent, or Firm*—Leydig, Voit, Osann, Mayer & Holt, Ltd.

[57] ABSTRACT

This invention is directed to a ukelele that is relatively simple yet sturdy in construction, produces a superior tone, is easy to hold and play, easy to tune, remains in tune for extended periods of time, and is useful in teaching people to play stringed instruments of the type where the strings are plucked to produce a musical tone. The sound box, in plan view, is constructed in the shape of a right angle triangle. The sound box has three circular sound openings positioned in a triangular pattern on the top surface of the sound box. The neck of the ukelele extends a substantial distance into the sound box. The strings of the ukelele pass through two sets of holes in the tuning head before being wound onto the tuning pegs.

6 Claims, 2 Drawing Figures

TEACHING UKELELE

This invention comprises a musical instrument that is useful in teaching music. More particularly, this invention comprises a ukelele that is relatively simple in construction, produces a superior tone, is easy to hold and play, easy to tune, remains in tune for extended periods of time, and is useful in teaching people to play stringed instruments of the type where the strings are plucked to produce a musical tone.

BACKGROUND OF THE INVENTION

Musical instruments such as ukeleles, guitars, mandolins, and the like, which consist of a sound box, keyboard and strings which are plucked to produce the musical tones, have been popular in many countries for many years. The more expensive and sophisticated stringed instruments are noted for producing superior tone and can be regarded as high quality musical instruments. These high quality instruments are usually well made and are owned by professionals who take care of their instruments. Less expensive versions of these instruments, usually owned by amateurs, suffer from a number of defects. For example, the construction of the sound box in the less expensive models is not very sturdy with the result that the sound box tends to warp with changes in humidity. Warping changes the shape of the sound box and affects the tone of the instrument, generally unfavourably. In many of the less expensive instruments, the pegs used to hold the strings in tension tend to slip in their holding sockets, particularly as the instrument becomes older, with the result that the strings repeatedly go out of tune. Consequently, the pegs must constantly be adjusted to keep the strings in tune.

Many of the less expensive constructions of stringed instruments also do not stand up very well to extensive use and rough handling. The less expensive instruments also tend to yield over a period of time to the tension applied by the strings being stretched between the sound box and the end of the neck bearing the fingerboard. As a result, the instrument with time assumes a "bowed" appearance and the strings move away from the fingerboard with the result that they must be pressed harder in order to touch the underlying fingerboard. Thus the instrument with time becomes more difficult to play. The bowing process usually continues with the constant retightening of the strings until eventually the instrument becomes useless and must be discarded.

SUMMARY OF THE INVENTION

I have invented a ukelele that stays in tune for long periods of time, is of relatively rugged construction and thus able to stand up to extensive use and rough treatment, and yields a consistent high quality tone under a wide range of conditions. The ukelele is also relatively simple in style and construction which means it is easy and inexpensive to build. The simple style also makes it an ideal tool for teaching people how to play a ukelele.

The sound box of my teaching ukelele, when viewed from the top or the bottom, is constructed in the shape of a right angle triangle. The sound box can be constructed according to a 30°-60°-90° triangle or two of the three corners of the sound box can be other angles less than 90° each, so long as one of the angles away from the fingerboard is a 90° angle. The neck of the teaching ukelele extends from the corner that has the smallest angle. THe sound box is positioned so that none of the three sides of the triangle aligns with the line of the extending neck. However, the neck extends in line with the top surface of the sound box, which is flat. This construction is advantageous because the ukelele does not require as much storage space as is the case with a ukelele that has a neck that extends at an angle with the line of the top of the sound box.

Unlike common ukeleles, my teaching ukelele has three circular sound openings positioned in a triangular pattern on the top surface of the sound box. The three openings are located in a triangular pattern that enhances the sound that is emitted by the sound box. The positioning and arrangement of the openings permits a larger proportion of the high frequency tones to be emitted from the sound box, while the lower frequency tones are less prominent.

The sides of the sound box are fastened directly to and meet smoothly with the two connecting sides of the neck. The neck extends a substantial distance into the sound box in order to provide strength and rigidity to the overall teaching ukelele. I have found that strength and rigidity are beneficial in providing an instrument that produces pleasing musical tones. Moreover, inherent strength and rigidity permit the teaching ukelele to stand up to long and continued use and withstand physical abuse.

The strings of my teaching ukelele are fastened to the neck and the sound box in what is believed to be a unique manner. Tuning pegs are located in a customary manner at the end of the neck away from the sound box. The various strings are wound around the respective tuning pegs. The respective tuning pegs are rotated which tightens the strings to their respective frequencies. Normally, in a stringed instrument, the strings extend directly from the tuning pegs to the bridge which is positioned on the top surface of the sound box. However, in my teaching ukelele, the strings extend only a short distance in the direction of the sound box before they are bent and passed downwardly through a set of holes positioned more or less laterally and extending more or less vertically in tuning head of the teaching ukelele. The number of holes correspond to the number of strings. The respective strings emerge on the underside of the tuning head whereupon they are bent further and passed for a certain distance in the direction of the sound box on the underside of the tuning head. The strings are then again bent upwardly and passed through a second set of more or less laterally positioned and vertically extending tuning head holes where the strings emerge again on the top of the tuning head. The strings are then bent further whereupon they again extend in the direction of the sound box where they then pass through a series of anchor holes located in the sound box where the strings are fastened. The advantage of my system of bending the strings through four turns by passing the strings through the first set of holes to the underside of the tuning head and then again through the second set of holes before they are passed to the bridge on the sound box is that the friction caused by having the strings pass through these respective holes tends to grip the strings and keep them in position and hence in tune. As a consequence, my teaching ukelele does not require frequent tuning as is the case in most conventional ukeleles. Moreover, the tuning pegs do not wear out as quickly because they do not need to be moved as frequently for tuning purposes as in conventional ukeleles. It will be recognized that variations in the arrangement and angles of the holes can be made in order to adapt to various needs.

The strings after passing over the bridge on the sound box are fixed in anchor holes. The anchor holes are located in the top of the sound box behind the bridge and have a reinforcing plate located on the underside of the top surface of the sound box. The anchor holes are specially slotted on the side where the strings pass into the respective anchor holes. This slotted construction "pinches" the strings thereby creating friction which tends to retard the strings working free. I have found that the strings anchored in the slotted anchor holes do not tend to work free as easily as in conventional instruments. Moreover, even if the anchor holes wear with time, and do not secure the strings as effectively, the anchoring system can be renewed merely by replacing the reinforcing plate.

Running the strings over a bridge enhances the sound emitted by the ukelele. The downward pressure on the bridge caused by the strings, coupled with the bridge making direct contact with the sound box, gives a fuller louder sound. Common ukeleles do not have a bridge, but have the strings fastened to an elongated bar attached to the sound box behind the sound holes. The tension to the strings on the bar is generally away from the sound box and hence a poorer quality of sound is produced.

DRAWINGS

DETAILED DESCRIPTION OF THE INVENTION

Figure 1:
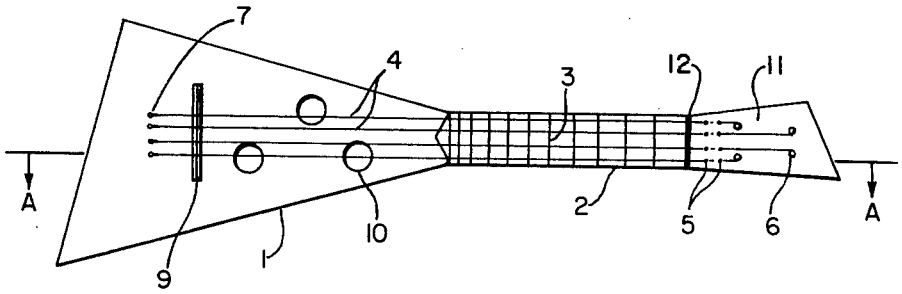
FIG. 1 shows an elevational view of the top of the teaching ukelele.

Referring to FIG. 1, it can be seen that the sound box 1 of the teaching ukelele is basically constructed according to the shape of a right angle triangle. As shown in FIG. 1, the lower most corner of the sound box 1 is a right angle, while the upper right hand corner of the sound box 1 is of an angle less than a right angle. As shown in the drawing, the upper right angle is approximately 60°. The third corner at the left hand side of the sound box is the smallest angle, approximately 30°, and is modified to receive the neck 2 and fingerboard 3 of the teaching ukelele. I have found that this right angle triangle style of sound box construction is easy and inexpensive to construct because there are no curved edges. I have also found that this construction of sound box produces a pleasing tone.

The sound box 1 can be constructed of straight sides of clear spruce, sized so that the depth of the sound box is approximately $1\frac{3}{4}$ inches. Of course, most of this depth is hollow in order to produce a cavity in which the sound produced by plucking the strings resonates, thereby amplifying and modifying the sound to produce a pleasing tone.

Figure 2:
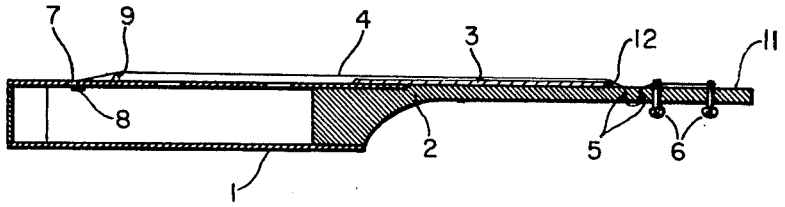
FIG. 2 shows a side view of the teaching ukelele taken along Section A—A of FIG. 1.

As can be seen in FIG. 2, the neck 2 extends for a substantial distance into the inside of sound box 1. This construction gives strength and rigidity to the overall teaching ukelele. This not only enables the teaching ukelele. This not only enables the teaching ukelele to withstand physical abuse, but to withstand forces which tend to warp or cause changes in the dimensional shape of the teaching ukelele. Any change in dimensional shape of the teaching ukelele is to be avoided as much as possible because the quality of the sound produced by the teaching ukelele tends to be diminished.

One problem with stringed instruments of the ukelele type construction is that the constant tension exerted by the strings 4 upon the tuning pegs 6 and the anchor holes 7 creates a bowing force on the neck 2 and the sound box 1. This force tends to cause the neck 2 and the sound box 1 to warp upwardly, which creates a number of associated problems. One is that the sound emitted by the stringed instrument is diminished somewhat in quality. Another is that the strings 4, as the bowed shape increases with time, become a greater distance from the fingerboard 3 with the result that the strings must be pressed harder by the fingers in order to cause the strings to come into contact with the fingerboard 3 at the appropriate locations to produce the various notes of the tonal scale. I have found that by having the neck 2 extend a substantial distance into the sound box 1, the neck 2 and the sound box 1 are of more unified construction and hence the neck 2 and sound box 1 are better able to withstand the tendency to curve upwardly due to the tension created by the strings 4.

The neck 2 is constructed of one piece of softwood. It will be noted when referring to FIG. 2 that the neck 2 and the sound box 1 on the top surface extend in a straight line. This permits the teaching ukelele to take up less space and to be packaged in a smaller container than is the case in many stringed instruments where the neck projects at an angle to the sound box.

Referring to FIGS 1 and 2, it will be seen that the fingerboard 3 is located on the top surface of the neck 2. This fingerboard 3 can be fastened to the top surface of the neck 2 by gluing, or by any other conventional technique.

It will be seen in referring to FIGS. 1 and 2 that four pairs of holes 5 corresponding with the four strings 4 penetrate vertically through a tuning head 11 between the nut 12 and of the tuning pegs 6. When stringing the teaching ukelele with strings 4, the strings 4, after being anchored in the respective anchor holes 7, and passing across bridge 9 and nut 12, then passing downwardly (See FIG. 2) at about a 90° angle through the first of the pairs of neck holes 5. After they emerge on the underside of tuning head 11, they are bent through a further 90° angle and then travel for a short distance along the underside of the tuning head 11 in the direction of the tuning pegs 6. They are then bent through a further 90° angle and strung upwardly through the second of the pair of holes 5. After emerging through the second of the pair of holes 5, on the top side of the tuning head 11, the strings are then bent through a final 90° angle and wound onto the tuning pegs 6.

This style of stringing has the great advantage of enabling the teaching ukelele to stay in tune for longer periods of time. The friction created by having the strings 4 pass through four right angles before being wound onto the tuning pegs 6 tends to grip the strings and thus the strings 4 are held at proper tension. The friction resists the tendency of the strings 4 to slip in response to the tension and thus go out of tune. Because the strings stay in tune for a longer period of time, This stringing arrangement also has the advantage of prolonging the life of the tuning pegs 6 because they do not have to be turned in their seats for tuning purposes as frequently as in conventional instruments.

The strings 4 are anchored in the sound box through respective anchor holes 7. It will be seen by referring to FIG. 1 that the anchor holes 7 are slotted on the side of the holes that face in the direction of the neck 2. These slotted anchor holes 7 tend to grip the strings 4 and thereby resist the tendency of the strings to work free due to the constant tension exerted on the strings 4. The anchoring of the strings 4 is also assisted by an anchor hole reinforcing plate 8 which is located in the interior of the sound box 1 on the underside of the top surface of the sound box 1 (See FIG. 2).

Since the strings 4 exert a constant tension on the anchor hole 7 and tend to work loose with time, the teaching ukelele is constructed so that reinforcing plate 8 can be replaced with a new reinforcing plate.

A bridge 9 (See FIGS. 1 and 2) is located on the top surface of the sound box 1 to the right of the anchor holes 7. This bridge 9 holds the strings 4 away from the fingerboard 3. Without the bridge, or a device that raises the strings away from the sound box 1, the strings cannot vibrate freely to produce a tone. The bridge 9 can be fastened to the top surface of the sound box 1 by gluing, or by any other conventional fastening method. With this bridge 9, the string pressure is exerted downwardly upon the bridge 9, thus eliminating the tendency common in other ukeleles of having the crossbar come loose.

Referring to FIG. 1, it will be seen that three sound openings 10 penetrate the top surface of the sound box 1 into the interior of the sound box 1. These three sound openings 10 are positioned according to a triangular pattern and are located on the top surface of the sound box 1 in a position that I have found enhances the quality of the sound emitted through the wound openings 10. The three sound openings 10, positioned according to a triangular pattern, and in association with the right angle triangle shape of the sound box 1, permit a larger proportion of the higher frequency tones to be emitted from the sound box 1, while the emission of the lower frequency tones of lower pitch are retarded. This combination enables the teaching ukelele to produce a superior quality of tone.

It should be noted that the foregoing detailed description of the invention describes only a preferred embodiment of my teaching ukelele. It is to be understood that one or more of the many features of my teaching ukelele can be applied to other forms of stringed instruments, and accordingly, my invention is not to be restricted to the detailed description provided. Any other constructions of ukelele or other stringed instruments that come within the spirit of my invention are to be considered to be included in the scope of the claims that follow this disclosure.

The embodiments of the invention in which an exclusive property or privilege is claimed are defined as follows:

1. In a stringed musical instrument of the type having a hollow sound box, a neck having a fingerboard mounted on the top surface thereof, a tuning head having tuning pegs, said tuning head being located at the end of said neck remote for said sound box, a nut mounted on the upper surface of said neck between said soundbox and said tuning head, a bridge mounted on said sound box, and a plurality of strings extending across said bridge, over said fingerboard and across said nut to said tuning pegs and attached thereto, the improvement comprising:

said tuning head having a pair of holes for each string penetrating through said tuning head between said nut and said tuning pegs for receiving said string at the upper surface of said tuning head and passing it to the lower surface thereof and for receiving said string at the lower surface of said tuning head and passing it to said upper surface.

2. The instrument of claim 1, wherein the sound box in plan view has fundamentally the shape of a right angle triangle.

3. The instrument of claim 2 wherein the instrument has four strings tuned according to different pitches and three sound openings penetrate to the interior of the sound box to enable the sound produced by vibrating the string to be resonated in the sound box, the three sound openings each being circular in shape, being positioned according to a triangular pattern, and being located underneath at least one of the respective strings.

4. The instrument of claim 3, wherein the triangular pattern created by the three sound openings is more or less congruent with the triangular shape of the sound box.

5. The instrument of claim 1 wherein the string is anchored in a slotted anchor hole located in the sound box, and a reinforcing plate is located under the anchor hole on the underside of the top surface of the sound box.

6. The instrument of claim 1 wherein the neck extends a substantial distance into the interior of the sound box.

* * * * *